US006053256A

United States Patent [19]

Lu

[11] Patent Number: 6,053,256

[45] Date of Patent: Apr. 25, 2000

[54] FIRE EXTINGUISHING SYSTEM

[75] Inventor: Bob K. Lu, Cerritos, Calif.

[73] Assignee: Pacific Scientific Company, Duarte, Calif.

[21] Appl. No.: 09/118,290

[22] Filed: Jul. 17, 1998

[51] Int. Cl.[7] ..... A62C 2/00; A62C 3/00

[52] U.S. Cl. ..... 169/46; 169/9; 169/28; 169/54; 169/61; 169/62; 137/513.3; 244/129.2

[58] Field of Search ..... 169/9, 26, 28, 169/29, 30, 46, 47, 54, 58, 60, 61, 62, 70, 71, 68, 45; 239/304, 309, 337, 373, 570, 571; 137/513.3; 244/129.2

[56] References Cited

U.S. PATENT DOCUMENTS

| | | | |
|---|---|---|---|
| 4,011,911 | 3/1977 | Gow | 169/29 |
| 4,299,289 | 11/1981 | Kato | 169/9 X |
| 4,319,640 | 3/1982 | Brobeil | 169/9 X |
| 4,328,867 | 5/1982 | Heath | 169/28 X |
| 4,643,260 | 2/1987 | Miller . | |
| 4,715,448 | 12/1987 | McCulloch | 169/62 |
| 5,038,867 | 8/1991 | Hindrichs et al. . | |
| 5,183,116 | 2/1993 | Fleming . | |
| 5,232,053 | 8/1993 | Gillis et al. | 169/58 |

OTHER PUBLICATIONS

Prior product mentioned on p. 1 of application.

*Primary Examiner*—Patrick Brinson
*Assistant Examiner*—Steven J. Ganey
*Attorney, Agent, or Firm*—Knobbe, Martens, Olson & Bear LLP

[57] ABSTRACT

A method for extinguishing fires in aircraft cargo spaces includes two pressure chambers separated by an annular boss which houses a restricting orifice and a check valve assembly. A lower chamber acts as a high rate discharge fire extinguisher and the upper chamber acts as a metering fire extinguisher. Upon receipt of an activation command from the cockpit, all the agent contained in the high rate discharge chamber is emptied within seconds. At the same time, the pressurized agent contained in the upper chamber pushes the check valve to a closed position and allows the agent in the metering chamber to flow through the orifice of the restrictor at a predetermined rate. With the properly sized orifice, the agent in the upper chamber will be emptied at a rate that lasts for the needed duration of the aircraft fire protection system.

16 Claims, 2 Drawing Sheets

FIRE EXTINGUISHING SYSTEM

FIELD OF THE INVENTION

The invention relates to fire extinguishers, particularly for use in aircraft cargo compartments and the like.

BACKGROUND OF THE INVENTION

Generally, the cargo space in commercial aircraft is inaccessible during flight. For this reason, most commercial aircraft rely on automatic fire-extinguishing systems to extinguish fires which occur in the cargo space and to keep the fire suppressed for the duration of the flight.

Most fire extinguishing systems for aircraft cargo spaces include two sources containing a fire extinguishing agent. The first source rapidly discharges the fire extinguishing agent to knock down the initial fire erupting within the cargo compartment. The second source releases the extinguishing agent at a much slower rate, and prevents fire from reigniting within the compartment. The rate of discharge is dependent on the size of the cargo space. Without the extended discharge, the concentration of the fire extinguishing agent in the cargo space could drop below what is necessary to keep the fire suppressed and embers could reignite the fire.

Previous fire extinguishing systems, such as U.S. Pat. No. 5,183,116 by Fleming, U.S. Pat. No. 5,083,867 by Hindrichs et al., and U.S. Pat. No. 4,643,260 by Miller, disclose the use of two independent fire extinguishers, consisting of two separate containers. Each container is equipped with its own charge valve, safety relief, pressure indicator, discharge outlet, explosive cartridge, rupture disc assembly, mounting lugs, and doublers. These types of systems take up excessive space, use longer piping connections, and require excessive time for installation onto the aircraft mounting platform.

Another type of fire extinguishing system is the "Bottle Within a Bottle" designed and manufactured by the Pacific Scientific Company in 1982. This design used an outer container as the high rate discharge fire extinguisher and an inner container as the metering fire extinguisher. While this system had several advantages over two separate extinguishers, relatively complicated weld structure joined the outer container and the inner container together to form a single fire extinguisher. The disadvantages of this design include the difficulty in monitoring the pressure of the inner container, the dependence of the outer container size on the size of the inner container, and the cost and complication of the design.

Thus, a need exists for a fire extinguishing system which not only is more compact, but also has fewer parts and increased reliability.

SUMMARY OF THE INVENTION

A dual chamber fire extinguisher system is provided with two pressure chambers joined together by a passage having a restricting orifice and preferably another passage controlled by a check valve assembly. One chamber acts as a high rate discharge fire extinguisher and the other chamber acts as a low rate discharge metering fire extinguisher. The dual fire extinguisher chambers are preferably joined by a suitable structure containing the passages. The chambers are normally stored in an upright position with the high rate chamber at the bottom and the metering chamber at the top, and with the fire-extinguishing agent stabilized between the two chambers. The size of the high rate discharge chamber is determined by the amount of fire extinguishing agent required to maintain a high agent concentration sufficient to knock down an initial fire erupting in a closed area such as an aircraft cargo compartment. The size of the metering chamber is determined by the duration required for maintaining a low agent concentration sufficient to prevent the fire from reigniting. This size is determined in part by the rate of the air leakage out of the cargo compartment.

The check valve permits the chambers to be filled through an inlet into the high rate discharge chamber and through the check valve into the low rate chamber. Conveniently, the unit may be inverted during the fill operation.

Upon receipt of an activation command signal from an aircraft cockpit, all the agent contained in the high rate discharge chamber is emptied through a suitable outlet within seconds. At the same time, the pressurized agent contained in the low rate chamber pushes the check valve to a closed position and allows the agent to flow through the orifice of a restrictor at a predetermined rate. With the properly sized orifice, the agent in the low rate chamber will be emptied at a rate that lasts for the entire duration of the needed fire protection.

The use of a single pressure container with two separate chambers is compact, relatively light, economical, flexible in multiple aircraft applications, reliable, and able to withstand a high vibration environment.

BRIEF DESCRIPTION OF THE DRAWINGS

These and other features of the present invention will be better understood by reference to the following detailed description when considered in conjunction with the accompanying drawings wherein.

DETAILED DESCRIPTION OF THE PREFERRED EMBODIMENT

Figure 1:
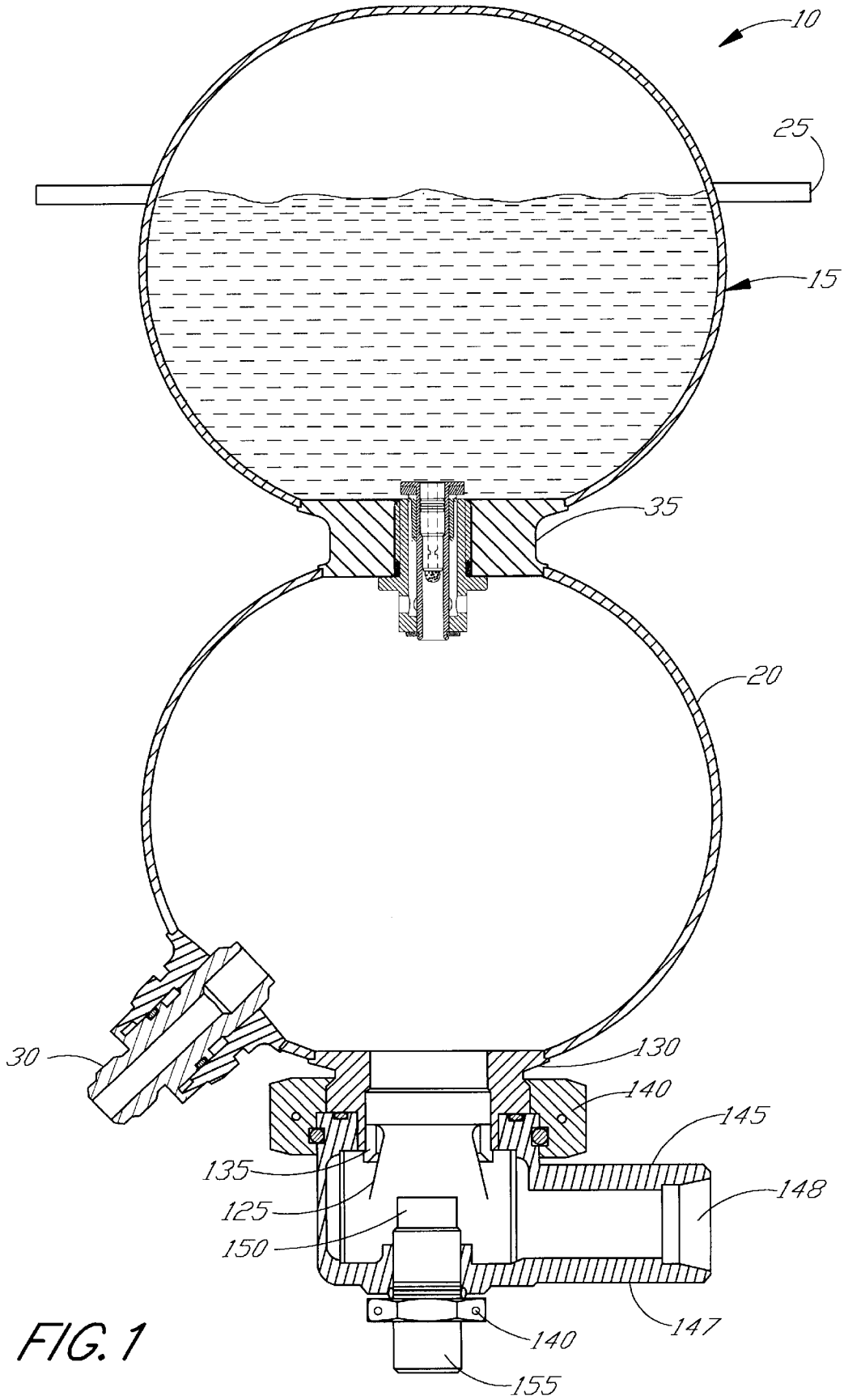
FIG. 1 is a cross-sectional view of a preferred embodiment of the fire extinguisher of the invention.

Referring now to the drawings, and particularly to FIG. 1, a fire-extinguisher of the invention, indicated generally by the numeral 10, includes an upper, low rate discharge pressure chamber 15 connected to a lower high rate discharge pressure chamber 20 by a generally circular flange or boss 35. Mounting lugs 25 are welded to the exterior of the upper pressure chamber and/or the lower chamber 20 for mounting the extinguisher 10 in an aircraft. A fill fitting 30 is attached to the exterior of the lower chamber 20.

Figure 2:
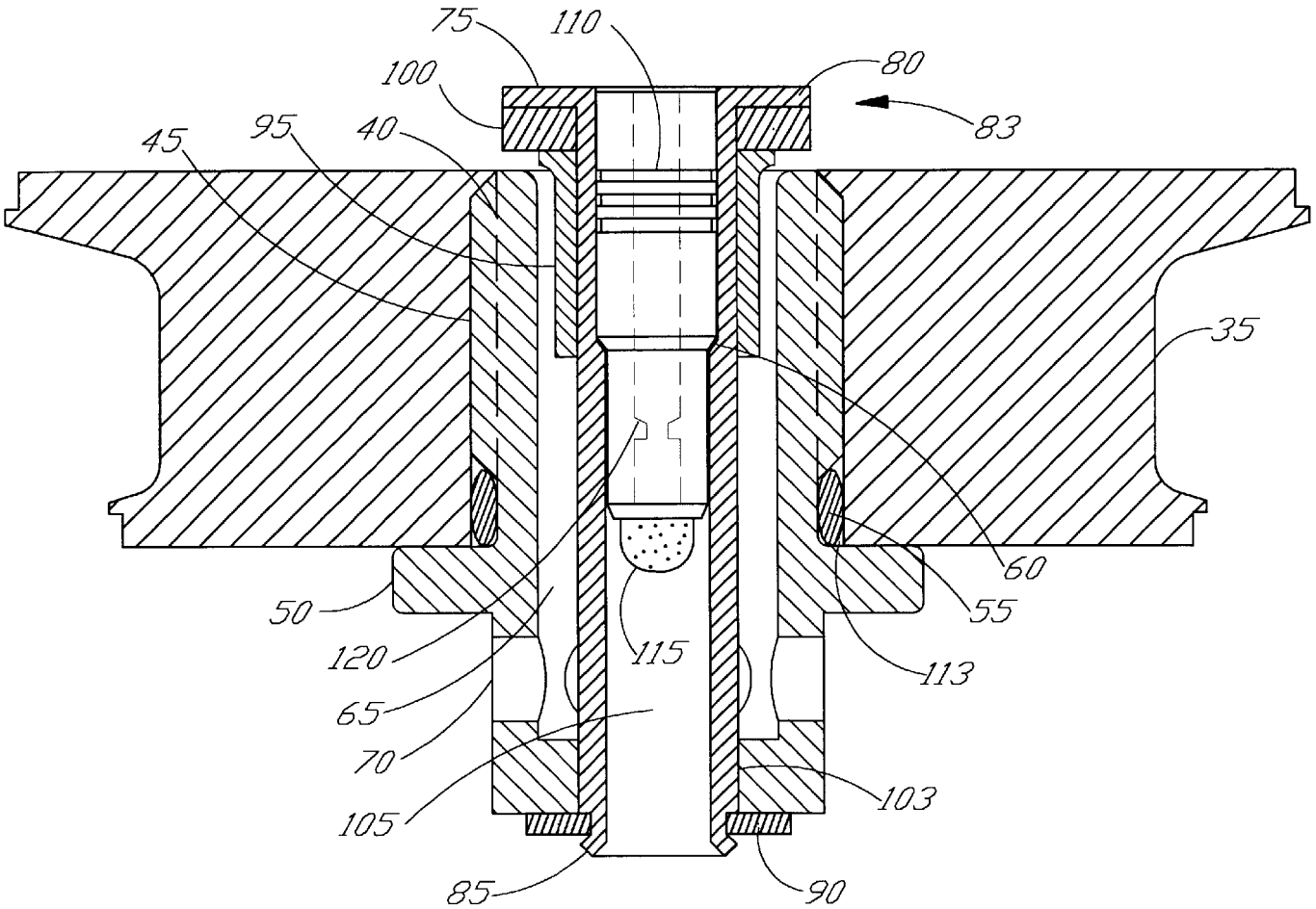
FIG. 2 is an enlarged cross-sectional view of the check valve and restrictor.

Referring to FIG. 2, a threaded bore 40 extends axially through the boss 35. A tubular housing 45 extends through the bore 40 with its exterior threadably mating with the threaded bore 40 of the boss 35. An outwardly extending flange 50 of the housing 45 lies flush against the lower surface of the boss 35. An O-ring 55 is inserted into a circumferential groove 60 formed in the housing 45 between the threaded portion of the housing 45 and the flange 50, to prevent leakage of a fire-extinguishing agent between the bore 40 and the housing 45. An internal passageway 65 is formed inside the housing 45 in communication with at least one inlet hole 70 extending through the side wall of the housing 45 beneath the flange 50, and adjacent to the lower end of the housing 45 as viewed in FIG. 2.

A tubular rod 75 extends through the passageway 65, protruding beyond the housing 45 at both the upper and lower ends. An outwardly extending flange 80 on the upper end of the housing 45 has an outer diameter larger than the internal diameter of the housing 45 so that the flange 80 forms a valve member 83 which, in combination with the housing 45 end, forms a check valve. A seal gasket 100 surrounds the rod 75 adjacent the flange 80 to complete the flange seal valve member 83 that seats against the end of the housing 45. The valve member 83 is shown in FIG. 2 in its open position. The gasket 100 is held in position by a sleeve 95 press-fit around the exterior of the rod 75. As can be seen, the outer diameter of the sleeve 95 is spaced from the inner diameter of the housing 45 so that fluid can flow through the open valve 83 passed the sleeve 95 into the remainder of the passageway 65.

The lower end of the rod 75 slidably fits within a bore 103 formed in a lower end wall of the housing 45. A retaining washer 90 surrounds a reduced diameter portion of the rod 75 and is captured in that position by a swaged lower end 85 of the rod 75. The washer 90 engages the lower surface of the housing 45 and thus limits the upward movement of the rod 75 to the valve 83 open condition illustrated in FIG. 2.

A rod bore 105 extends axially through the tubular rod 75, and a restrictor 110 is positioned in the bore 105. As seen, the upper portion of the restrictor 110 has a larger exterior diameter than the lower portion and it engages a shoulder 113 on the interior of the rod 75 formed by the upper portion of the rod bore 105 which has a larger inner diameter than does the lower portion. The restrictor 110 is tubular and includes a fixed metering orifice 120 and a filter 115 mounted on its lower end.

Referring back to FIG. 1, a discharge head assembly 145 is positioned in the lower end of the high-rate discharge chamber 20. That assembly includes a tubular exhaust fitting 130 secured to the lower end of the chamber 20 and a frangible burst disk 125 (shown in the burst condition) secured around its outer periphery to the inside of the exhaust fitting 130 by a threaded retainer 135. The discharge head assembly 145 includes a discharge head 147 which is sealed to the exterior of the fitting 130, being held in place by a nut 140. An explosive cartridge 150 is threaded into the lower end of the discharge head 147 and is connected to an electrical connector 155. The discharge head includes an outlet 148.

The fire extinguisher is charged through the fill fitting 30, and is more conveniently operated with the fire extinguisher inverted from the position shown in FIG. 2. In either case, the fire extinguishing agent opens the check valve 83 formed by the rod flange 80, moving it to the open position illustrated in FIG. 2. Note that the stop washer 90 limits the opening travel of the rod 75. The extinguishing agent travels through inlets 70 and through the interior annular passageway 65 to open the valve 83 and allow flow into the metering chamber 15. In this way, both the metering chamber 15 and the high-rate discharge chamber 20 are charged with the fire extinguisher agent. A commonly used agent is bromotrifluoromethane (Halon), being superpressurized to about 360 P.S.I.A. at 70° F. in both chambers utilizing nitrogen or some other suitable gas.

When a fire is detected, the explosive cartridge 150 is remotely activated such as from the cockpit of an airplane, causing the burst disk 125 to rupture as shown in FIG. 2. Once the disc 125 is ruptured, the fire-extinguishing agent flows from the high-rate discharge chamber 20 and through the outlet 148 of the discharge head 147. The Halon agent from the high-rate discharge chamber 20 is rapidly discharged to ensure a minimum concentration in the aircraft cargo compartment of about 5% volume for an initial flame knockdown of a fire in the compartment.

As the pressure in the high-rate discharge chamber 20 decreases, the pressurized agent in the metering pressure chamber 15 will push the valve member 83 downward into its closed position causing the seal 100 to engage the upper surface of housing 45. This prevents the fire extinguishing agent in the metering chamber 15 from traveling through passageway 65. The agent will, however, continue to flow through the orifice 120 of the restrictor 110 and the filter 115 at a predetermined rate to ensure approximately a 3% by volume extinguishing agent concentration for a predetermined time in the compartment to adequately control or extinguish a fire in the compartment.

The fire extinguisher also has a safety relief valve and pressure gauge (not shown) associated with each pressure chamber.

What is claimed is:

1. A fire extinguishing system comprising:

a high rate discharge chamber for discharging a fire extinguishing agent at a high rate to quickly extinguish a fire in a confined area;

a metering chamber for discharging the fire extinguishing agent at a low rate to prevent said fire from reigniting;

a check valve located in a first passage connecting said chambers, said check valve permitting flow of the agent from the high rate discharge chamber to the metering chamber, but preventing flow from the metering chamber to the high rate discharge chamber when the pressure in the metering chamber exceeds the pressure in the high rate discharge chamber;

an orifice located in a second passage connecting said chambers, said orifice metering flow from the metering chamber to the high rate discharge chamber when the pressure in the metering chamber exceeds the pressure in the high rate discharge chamber; and a discharge outlet connected to said high rate discharge chamber, through which the fire extinguishing agent exits to the confined area.

2. The system of claim 1, including a structure connecting said chambers, and wherein the first and second passages extend through the structure.

3. The system of claim 1, including an annular boss having one end connected to one chamber and the other end connected to the other chamber, and said passages extend through said boss.

4. The system of claim 3, wherein said check valve is mounted in said boss and includes a tubular rod having a flange on one end which forms a moveable valve member of said check valve, and said second passage extends through said tubular rod.

5. The system of claim 4 including:

a housing positioned in said boss, said housing including a bore wherein one end of the bore opens to the high rate discharge chamber and an opposite end of the bore opens to the metering chamber, and an end of said housing forms a valve seat for said valve member; and said rod is slidably mounted in said housing with a major portion of the rod spaced from the bore to define said first passage.

6. The system of claim 1, wherein said discharge outlet includes a frangible disc and an explosive cartridge for rupturing the disc when the contents of the high rate discharge chamber are to be discharged from the chamber.

7. The system of claim 1, including a fill fitting located in a wall of the high rate discharge chamber for charging the system with a fire extinguishing agent.

8. A fire extinguishing system for extinguishing fires in a confined space, comprising:

a pressure container divided into:

a high rate discharge chamber for discharging a fire extinguishing agent at a high rate to quickly extinguish a fire in the confined area;

a metering chamber for discharging the fire extinguishing agent at a low rate to prevent said fire from reigniting;

a boss joining said chambers, said boss housing an orifice restricting flow of the agent from the metering chamber to the high rate discharge chamber;

a discharge outlet connected to the high rate discharge chamber through which the fire extinguishing agent exits to the confined area; and a fill fitting located on said container for charging the container with the fire extinguishing agent.

9. The fire extinguishing system of claim 8 wherein the boss houses a check valve which is opened by the fire extinguishing agent when the fire extinguishing system is charged to permit flow of the agent from the high rate discharge chamber to the metering chamber.

10. The fire extinguishing system of claim 9 wherein the orifice is housed within the check valve.

11. The fire extinguishing system of claim 8 including an explosive cartridge and a rupture disc assembly connected to said discharge outlet.

12. A fire extinguishing system for extinguishing fires in the cargo space of a vehicle comprising:

two pressure chambers including an upper chamber having a bottom connected to the top of a lower chamber by a boss to form a single unit, said boss housing a check valve which is opened when the fire extinguishing system is being charged with a fire extinguishing agent to permit flow of the agent from the lower chamber to the upper chamber;

a fill fitting connected to said lower chamber for charging the chambers with said agent;

a discharge outlet in said lower chamber; and a restricting orifice in said boss which meters flow of the fire extinguishing agent from the upper chamber to the lower chamber when the agent discharges from the lower chamber.

13. A method of extinguishing a fire in an aircraft cargo compartment, comprising the steps of:

charging the upper and lower chambers of a fire extinguisher with an extinguishing agent;

pressurizing said chamber with gas;

sending an activation command causing the lower chamber to discharge the extinguishing agent from the lower chamber into the compartment; and metering flow of the extinguishing agent from the upper chamber to the lower chamber through a metering orifice when the pressure in the upper chamber exceeds the pressure in the lower chamber.

14. The method of claim 13 including the steps of:

charging the extinguisher through a fitting mounted in the wall of said lower chamber, with the chambers inverted during the charging step; and returning the fire extinguisher to a position in which the upper chamber is above the lower chamber.

15. A method for controlling a fire in a confined area comprising the steps of:

discharging a fire extinguishing agent at a higher rate from a discharge chamber to quickly extinguish a fire in the confined area;

metering flow from a metering chamber to the discharge chamber at a slow rate through an orifice in a first passage connecting the chambers, when the pressure in the metering chamber exceeds the pressure in the discharge chamber;

discharging from the discharge chamber agent metered to the discharge chamber at a low rate from the metering chamber to prevent the fire from reigniting; and permitting the flow of the agent from the discharge chamber to the metering chamber through a check valve in a second passage connecting the chambers, but preventing flow from the metering chamber to the discharge chamber when the pressure in the metering chamber exceeds the pressure in the discharge chamber.

16. A method of utilizing a fire extinguisher having a high rate discharge chamber and a metering chamber spaced from the high rate discharge chamber by a connection joining the chambers, said method comprising the steps of:

positioning the extinguisher so that the discharge chamber is above the metering chamber;

charging the chambers with a fire extinguishing agent through a fitting mounted in a wall of the discharge chamber, the agent flowing into the metering chamber through a check valve in said connection;

pressurizing the chambers with gas;

inverting the chambers so that the metering chamber is above the discharge chamber;

discharging the agent from the discharge chamber at a high rate to quickly extinguish the fire in a confined area; and metering the agent from the metering chamber into the discharge chamber at a low rate when the pressure in the metering chamber exceeds the pressure in the discharge chamber to permit the agent to flow from the discharge chamber into the confined area at a low rate to prevent the fire from reigniting.

* * * * *